US007425525B2

(12) United States Patent
Akiyama et al.

(10) Patent No.: US 7,425,525 B2
(45) Date of Patent: Sep. 16, 2008

(54) WASHING SOLUTION FOR INKJET PRINTER HEAD AND WASHING METHOD USING THE SOLUTION

(75) Inventors: Ryozo Akiyama, Mishima (JP); Toru Ushirogouchi, Yokohama (JP); Mitsuru Ishibashi, Yokohama (JP); Kazuhiko Ohtsu, Mishima (JP); Masashi Hiroki, Yokohama (JP)

(73) Assignee: Toshiba Tec Kabushiki Kaisha (JP)

( * ) Notice: Subject to any disclaimer, the term of this patent is extended or adjusted under 35 U.S.C. 154(b) by 378 days.

(21) Appl. No.: 11/063,474

(22) Filed: Feb. 23, 2005

(65) Prior Publication Data

US 2006/0017769 A1 Jan. 26, 2006

(30) Foreign Application Priority Data

Jul. 22, 2004 (JP) ..... 2004-214816

(51) Int. Cl.
*C11D 7/00* (2006.01)

(52) U.S. Cl. ..... 510/247; 134/22.1; 347/28

(58) Field of Classification Search ..... 510/247; 134/22.1; 347/28

See application file for complete search history.

(56) References Cited

U.S. PATENT DOCUMENTS

| | | | | |
|---|---|---|---|---|
| 3,150,166 | A | 9/1964 | Pohlemann et al. | |
| 4,688,055 | A * | 8/1987 | Noguchi et al. | 347/65 |
| 5,549,852 | A * | 8/1996 | Bell | 510/299 |
| 5,830,620 | A * | 11/1998 | Harada et al. | 430/272.1 |
| 5,910,531 | A * | 6/1999 | Freeman et al. | 524/556 |
| 6,146,769 | A * | 11/2000 | Anton | 428/500 |
| 6,166,100 | A | 12/2000 | Hiwara et al. | |
| 6,368,772 | B1 * | 4/2002 | Telser et al. | 430/281.1 |
| 6,433,117 | B1 * | 8/2002 | Ma et al. | 526/277 |
| 6,989,054 | B2 * | 1/2006 | Tanabe et al. | 106/31.86 |
| 2002/0068772 | A1 | 6/2002 | Laksin et al. | |
| 2002/0077385 | A1 | 6/2002 | Miyabayashi | |
| 2002/0188033 | A1 | 12/2002 | Maeda | |
| 2003/0135059 | A1 | 7/2003 | Matsumura et al. | |

FOREIGN PATENT DOCUMENTS

| | | | |
|---|---|---|---|
| DE | 100 47 622 | A1 | 6/2000 |
| EP | 1 070 592 | A1 | 1/2001 |
| EP | 1 167 043 | A1 | 1/2002 |
| JP | 2-263654 | | 10/1990 |
| JP | 4-115954 | | 4/1992 |
| JP | 9-300637 | | 11/1997 |
| JP | 10-315487 | | 2/1998 |
| JP | 11-058776 | | 3/1999 |
| JP | 2002-105500 | | 4/2002 |
| JP | 2003-145745 | | 5/2003 |
| JP | 2003-292837 | | 10/2003 |
| JP | 2004-137302 | | 5/2004 |
| WO | WO 93/17867 | | 9/1993 |

OTHER PUBLICATIONS

Communication from European Patent Office re: related application.
Fried, MJ et al, "Stabilisierung von Acrylmonomeren", Farbe + Lack, vol. 100, No. 8, Aug. 1994, pp. 604-609.
Communication (with translation) from Japanese Patent Office re: related application Nov. 2007.

* cited by examiner

*Primary Examiner*—Gregory E Webb
(74) *Attorney, Agent, or Firm*—Harness, Dickey & Pierce, P.L.C.

(57) ABSTRACT

There is proposed a washing solution for washing an inkjet printer head which performs printing by feeding an ink comprising at least two kinds of polymerizable compounds each differing in viscosity, a photopolymerization initiator, and pigment. This washing solution is characterized in that it contains not less than 50 parts by weight of a polymerizable compound selected from the polymerizable compounds included in the ink and having a lowest viscosity among the polymerizable compounds, or not less than 50 parts by weight of a polymerizable compound having a viscosity of 30 mPa·sec or less at ordinary temperature.

18 Claims, No Drawings

WASHING SOLUTION FOR INKJET PRINTER HEAD AND WASHING METHOD USING THE SOLUTION

CROSS-REFERENCE TO RELATED APPLICATIONS

This application is based upon and claims the benefit of priority from prior Japanese Patent Application No. 2004-214816, filed Jul. 22, 2004, the entire contents of which are incorporated herein by reference.

BACKGROUND OF THE INVENTION

1. Field of the Invention

This invention relates to a washing solution for inkjet printer head and to a washing method using the washing solution.

2. Description of the Related Art

In recent years, there has been widely employed, as an on-demand printer, an inkjet printer which is capable of achieving high-velocity and high-quality printing. As for the ink to be employed in this inkjet printer, they include a water-soluble type ink, a solvent type ink, a photosensitive ink, etc. Among them, the photosensitive ink is expected to be especially preferable for use because of the facts that it includes substantially no poisonous components that may be discharged into external atmosphere and that it is excellent in quick drying. Further, as for the coloring materials to be employed in this inkjet printer, pigment type coloring materials are considered useful to realize the printing of improved water resistance and improved weathering resistance.

This inkjet printer is generally operated in such a manner that a pressure wall which is electrically controlled is actuated so as to enable a predetermined quantity of ink droplet to discharge from an ink discharge port (hereinafter referred to simply as a nozzle) having a diameter of several tens micrometers. The ink droplet is required to be ejected rectilinearly and in a desirable configuration. Further, it is also required that discharge failures that may result from the clogging of the nozzle should be prevented as much as possible. When the components of ink adhere to a region in the vicinity of the nozzle or to the inner wall of printer head, the pigments may be caused to flocculate or the solvent component of ink may be cured, thereby deteriorating the discharge performance of the inkjet printer. This discharge performance however can be restored by cleaning the nozzle with a suitable washing solution.

Various kinds of washing solutions for inkjet printer have been conventionally proposed. All of these washing solutions are designed to be used for the inkjet printers where a water soluble ink is employed, so that even if these washing solutions are applied to an inkjet printer where a photosensitive ink is employed, it would be impossible to expect desirable detergency. A washing solution comprising a solvent for ink and dimethyl sulfoxide is also proposed. Owing to the effects of the solvent of ink, this washing solution is highly effective in dissolving the adhered matters of ink. However, once dimethyl sulfoxide remains inside the printer head, it may act as an impurity.

BRIEF SUMMARY OF THE INVENTION

Therefore, one of the objects of the present invention is to provide a washing solution which is capable of effectively washing the inkjet printer head where a photosensitive ink is employed. Another object of the present invention is to provide a washing method of such an inkjet printer head.

According to one aspect of the present invention, there is provided a washing solution for washing an inkjet printer head which performs printing by feeding an ink comprising at least two kinds of polymerizable compounds each differing in viscosity, a photopolymerization initiator, and pigment; wherein the washing solution contains not less than 50 parts by weight of a polymerizable compound selected from the at least two kinds of polymerizable compounds included in the ink and having a lowest viscosity among the at least two kinds of polymerizable compounds, or not less than 50 parts by weight of a polymerizable compound having a viscosity of 30 mPa·sec or less at ordinary temperature.

According to another aspect of the present invention, there is provided a washing method for washing an inkjet printer head comprising filling the interior of an inkjet printer head with the washing solution aforementioned; and discharging the washing solution from a nozzle of the inkjet printer head.

Additional objects and advantages of the invention will be set forth in the description which follows, and in part will be obvious from the description, or may be learned by practice of the invention. The objects and advantages of the invention may be realized and obtained by the instrumentalities and combinations particularly pointed out hereinafter.

DETAILED DESCRIPTION OF THE INVENTION

Next, various embodiments of the present invention will be explained as follows.

The washing solution according the embodiments of the present invention is adapted to be employed in the inkjet printer where a photosensitive ink is employed. This photosensitive ink comprises at least two kinds of polymerizable compounds each differing in viscosity, a photopolymerization initiator, and pigment. The polymerizable compounds are also called polymerizable solvents or photosensitive solvents and are constituted by a monomer or an oligomer. The reasons for employing at least two kinds of polymerizable compounds each differing in viscosity in the photosensitive ink are that when polymerizable compounds differing in viscosity from each other are employed, it becomes easier to control the viscosity of the photosensitive ink so as to formulate the ink having a predetermined viscosity. The viscosity of the polymerizable compound is generally confined to range from several tens to about 100 mPa·sec if the ink is desired to have a higher viscosity and to range from several to about several tens mPa·sec if the ink is desired to have a lower viscosity.

In the operation of the inkjet printer where a photosensitive ink is employed, the printing of an image is performed by the ejection of ink droplet to a medium, in which the driving frequency is generally 4 KHz or more. The printer head may be swept relative to a printing surface of the medium in any manner, so that the printer head may be scanned unidirectionally only once to perform the printing of large printing area at a high velocity. The printer of this kind is mainly applicable to an inkjet recording apparatus for business use, so that the discharge performance thereof is required to be more severe as compared with a home printer to be employed in the printing of images in a personal computer or a digital camera. Once streak lines generate in the printed image in the aforementioned unidirectional printing due to fading of image or missing of dots that may generate due to discharge error of ink, it would be impossible to correct such streak lines. Therefore, the discharge performance of the printer head has a great influence on the quality of printed matter to be obtained. One of the causes for deteriorating the discharge performance is the adhesion of flocculated pigment or solidified ink components onto a region of the printer head in the vicinity of the nozzle, which may fluctuate the ejectability of ink droplet. These adhered matters or deposits are required to be quickly removed away from the printer head by washing which can be performed by using a washing solution.

Therefore, what is required for a washing solution to be used for the inkjet printer is, in the first place, to wash out the flocculated pigment and the solidified ink components. The viscosity of the washing solution should preferably be lower than the ink to be employed. Further, the washing solution is required to be such that when it is mixed with the ink inside the printer head, there is no possibility of generating the flocculation of the pigments employed in the ink. Additionally, it is also important that there are no possibilities of generating other solid matters and gel-like matters. Of course, it is also required that the washing solution itself contains no solid matter and gel-like matter and is incapable of being cured by a beam of light such as ultraviolet rays. Additionally, the washing solution is also capable of serving as a preserving solution for preventing the deterioration of the performance of the printer head.

It has been found as a result of extensive studies made by the present inventers on the washing solution for an inkjet printer using a photosensitive ink that a washing solution which contains not less than 50 parts by weight of a polymerizable compound selected from the polymerizable compounds contained in the ink and having a lowest viscosity among the polymerizable compounds, or not less than 50 parts by weight of a polymerizable compound having a viscosity of 30 mPa·sec or less at ordinary temperature is capable of exhibiting an effective detergency, thus accomplishing the present invention. Namely, by using this washing solution which contains not less than 50 parts by weight of a polymerizable compound having a lowest viscosity among the polymerizable compounds, or not less than 50 parts by weight of a polymerizable compound having a viscosity of 30 mPa·sec or less at ordinary temperature, it is now possible to enhance the fluidity of the ink without deteriorating the compatibility thereof with the ink, thereby making it possible to easily discharge solidified matters originating from the ink and existing inside the printer head from the interior of the printer head.

The detergency of the washing solutions according the embodiments of the present invention can be further enhanced by formulating them so as to have a viscosity at the composition ratio as represented by the following formula (1), i.e. 30 mPa·sec or less at ordinary temperature. By using this formula (1), a viscosity of a mixed solution comprising two or more kinds of polymerizable compounds each differing in viscosity and mixed-together at a certain mixing ratio can be approximately estimated, thereby making it possible to ascertain the usefulness of the washing solution in the formulation thereof. The intrinsic viscosity $\eta_t$ of polymerizable compounds can be easily measured by using a general cone plate type viscometer.

$$\eta_t=\exp(\chi_1\cdot 1n(\eta_1)+\chi_2\cdot 1n(\eta_2)+\chi_3\cdot 1n(\eta_3)+\ldots+\eta_n\cdot 1n(\eta_n)) \quad \text{formula (1)}$$

wherein $\chi_1, \chi_2, \chi_3, \ldots \chi_n$ represent weight ratio of each of the components of composition, respectively; and $\eta_1, \eta_2, \eta_3, \ldots \eta_n$ represent viscosity of each of the components of composition, respectively, at ordinary temperature.

If the viscosity of the washing solution is higher than the aforementioned range, solid matters generated in the printer head would be entrapped in the washing solution to deteriorate the discharging performance of the washing solution. Furthermore, it may be required to increase the pressure for discharging the washing solution, thus giving rise to the damages of not only the printer head but also the tubes and connectors of ink supply system which are communicated with the printer head.

The solubility parameter S2($MPa^{1/2}$) of the washing solutions according to the embodiments of the present invention should preferably be confined within the range to be represented by the following formula (2) as the solubility parameter S1($MPa^{1/2}$) of the ink to be washed is taken into account.

$$S1-2\leqq S2\leqq S1+2 \quad \text{formula (2)}$$

In the case of the ink containing n kinds of polymerizable compounds (solvents), since each of the solvents has a solubility parameter which is inherent thereto, it is possible to make the solubility parameter of the washing solution fall within the aforementioned range on the occasion of formulating the washing solution. The washing solutions according to the embodiments of the present invention may be further incorporated with a polymerizable solvent which is not yet included in the ink, thereby making it possible to formulate the washing solution so as to make the solubility parameter thereof fall within the aforementioned range by taking into consideration the solubility parameter inherent to the polymerizable solvent. When the solubility parameter S2 of the washing solution falls outside the aforementioned range, the cohesiveness of the pigments in the ink may be promoted. Additionally, when the solubility parameter S2 of the washing solution falls outside the aforementioned range, the wettability of the washing solution to the solid matters originating from the ink may be deteriorated to deteriorate the detergency of the washing solution to the printer head. The solubility parameter can be empirically determined. Alternatively, on the basis of the formulas described in documents such as "Polymer Handbook", the solubility parameter can be determined from the chemical structures.

The washing solution for inkjet printer head is required to be free from any solid impurities. In the washing solution according to the embodiments of the present invention, the detergency thereof can be further enhanced by limiting the number of particles having a diameter of not less than 0.5 μm to not more than 5000 per 10 cc.

Incidentally, in the case of photosensitive ink to be washed, if the particle having a diameter of 0.5 μm or more is contained, the discharge performance of the ink would be extremely deteriorated. Therefore, pigment particles are dispersed in the ink by limiting the diameter of pigment particles to less than 0.5 μm. In the case of the washing solution also, since the existence of particles of such a large size would cause the deterioration of the performance of the washing solution, it is required to limit the number of particles of large size as small as possible. Particles having a diameter of 0.5 μm or more can be easily removed by recycling filtration using a cassette filter having a diameter of 1 μm for instance. The refining of particles may be performed also by a centrifugal treatment. The number of particles in the washing solution can be easily counted by using Accusizer (trade name, Particle Sizing Systems Co., Ltd.).

Since relatively large particles having a diameter of 0.5 μm or more would cause the deterioration of the discharge performance as mentioned above, the existence of such large particles is undesirable when mixing the washing solution with the ink. Namely, the washing solution should desirably be such that it is capable of preventing the pigments in the ink from flocculating into particles of larger size. More specifically, the washing solution should desirably be such that when the photosensitive ink to be washed is diluted 20000-fold with the washing solution, the number of particles having a diameter of 0.5 μm or more in the diluted solution should be confined to 50000 or less per 10 cc. The washing solution having such features can be prepared by using the same solvent as that employed in the photosensitive ink or by using a mixture comprising the aforementioned same solvent and a proper quantity of a suitable surfactant, preferably the same pigment dispersant as employed in the ink. By using such a washing solution, it is possible to realize a further enhanced detergency.

It has been found out by the present inventors that the number of relatively large particles in the washing solution can be controlled by zeta potential. More specifically, when the zeta potential of the ink to be washed is defined as Z1(mV) and the zeta potential of a 10-fold to tens of thousands-fold dilute ink solution which is diluted with the washing solution is defined as Z2(mV), if a difference between Z1 and Z2 is not more than ±10 mV, there is substantially no possibilities of remaining aggregates having a diameter of 0.5 μm or more inside the printer head. As a result, the detergency of the washing solution can be further enhanced. On the other hand, if the aforementioned difference of zeta potential exceeds ±10 mV, the flocculation of pigments would be promoted so that aggregates having a diameter of 0.5 μm or more may remain inside the printer head. In order to avoid such inconveniences, the aforementioned Z1 and Z2 should preferably be of the same sign with each other. Incidentally, the zeta potential can be easily measured by using ELS-8000 (Ohtsuka Denshi Co., Ltd.) for instance.

The washing solution where the difference between Z1 and Z2 is confined to ±10 mV or less can be prepared, as mentioned-above, by using the same solvent as that employed in the photo-curable ink or by using a mixture comprising the aforementioned same solvent and a proper quantity of a suitable surfactant, preferably the same kind of pigment dispersant as employed in the ink.

The ink to which the washing solutions according to the embodiments of the present invention are applicable is a photo-curable ink comprising at least two kinds of polymerizable compounds, a photopolymerization initiator, and pigment. There are possibilities that the reaction of the polymerizable solvents take place to a certain extent even by the irradiation of light of low energy which is fairly lower than the energy of the light irradiation which is required for the curing of the ink, such for example as the irradiation of sun light entering into the ordinary room, or by the irradiation of a fluorescent lamp. When the polymerizable solvents are polymerized, a gel-like material generates locally. This kind of phenomenon can also occur when thermal changes or changes with time occur in the polymerizable solvent. Even in the case of the washing solutions according to the embodiments of the present invention, there are possibilities of generating a gel-like material. However, existence of gel-like residues inside the printer head is not desirable. Once thermal changes or changes with time take place in the washing solution, they will lead to the deterioration in ejection performance of the ink when performing the printing operation by filling the printer head with the ink after the washing thereof. Therefore, it is required to formulate the washing solution such that thermal changes or changes with time would hardly take place therein.

The washing solution can be also employed as a preservation solution for the maintenance of the printer head. Because, if the printer head is stored with the ink being filled therein, the solid matters that have been generated in the ink due to the deterioration with time of the ink may adhere onto the inner wall of the head or a region in the vicinity of the nozzle, thereby deteriorating the performance of the printer head. In this case also, the washing solution should be formulated such that thermal changes or changes with time would hardly take place therein. This can be accomplished by adopting the following means.

For example, a polymerization inhibitor may be incorporated into the washing solution so as to retard the polymerization reaction of the polymerizable solvents, thereby making it possible to enhance the washing efficiency of the washing solution. As for the polymerization inhibitor, it is applicable to either a radical polymerization type solvent or a cationic polymerizable solvent. This polymerization inhibitor is effective to the radical polymerization type solvent in neutralizing the radicals to be generated therefrom. Further, this polymerization inhibitor is effective to the cationic polymerizable solvent in neutralizing the acids to be generated therefrom.

When the ink to be washed contains a polymerizable compound having one polymerizable functional group, this polymerizable compound may be incorporated into the washing solution. Generally speaking, the larger is the number of polymerizable functional group that has been included in the polymerizable compound, the more it becomes easier to proceed the polymerization of the polymerizable compound. Therefore, when a polymerizable compound having a smaller number of polymerizable functional group is used, the progress of the polymerization reaction can be retarded, thereby making it possible to enhance the washing effects of the washing solution.

Further, when the ink to be washed contains a polymerizable compound having a polymerizable functional group selected from the group consisting of vinyl group, acryloyl group, (metha)acryloyl group, glycidyl group, oxetane and oxirane, the polymerizable compounds represented by the following general formula (1) may be incorporated into the washing solution.

$$(A^1)_m\text{-R-}(A^2)_{n-m} \qquad \text{General formula (1)}$$

(wherein R is an aliphatic skeleton, an alicyclic skeleton or a skeleton containing oxygen atom; $A^1$ is an organic group which is inert to a photopolymerization initiator to be included in the ink; $A^2$ is a group selected from the group consisting of an organic group which is inert to a photopolymerization initiator to be included in the ink, vinyl group, acryloyl group, (metha)acryloyl group, glycidyl group, oxetane and oxirane; n is a natural number of 2 or more; and m is a natural number ranging from 1 to not more than n.) As for the aliphatic skeleton to be introduced into R, it is possible to employ alkylene group having 1 to 6 carbon atoms or a hydroxyl group-substituted alkylene group. As for the alicyclic skeleton, it is possible to employ an alicyclic skeleton having 6 to 15 carbon atoms. More specifically, examples of the alicyclic skeleton include the following skeletons.

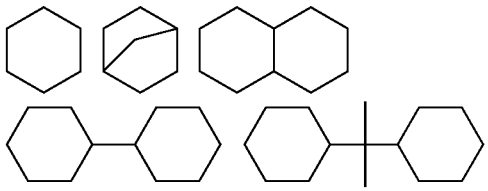

-continued

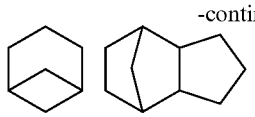

As for the skeleton containing oxygen atom, it is possible to employ the following skeletons for example.

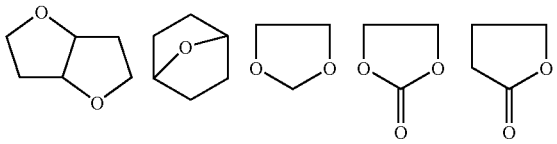

As for the organic groups which are inert to a photopolymerization initiator and introduced into $A^1$ and $A^2$, respectively, it is possible to employ, for example, methyl, ethyl, methoxy, ethoxy, isopropyl and t-butyl groups. It is most preferable that all of the polymerizable functional groups are substituted by these inert organic groups. However, even if only one of the polymerizable functional groups is substituted by one of the inert organic groups, the activity of the polymerizable compound can be reduced, resulting in enhancement of the washing effects of the washing solution.

The washing solutions according to the embodiments of the present invention are introduced into the interior of the inkjet printer head at first and then discharged from the nozzle, thereby cleaning the interior of the printer head as well as a region in the vicinity of the nozzle. In this case, it is preferable to apply a pressure ranging from 1 kPa to 100 kPa or so to the washing solution. Specifically, the washing solution is delivered from an ink supply passageway which is communicated with the printer head into the printer head. On this occasion, the pressure may be suitably adjusted in the discharge of the washing solution from the nozzle, or alternatively, a rubber tube may be employed to forcedly suck the washing solution from the nozzle filled with the washing solution so as to prevent the inner surface of nozzle from being damaged. Under some circumstances, for the purpose of discharging the washing solution, the printer head may be actuated to perform the same operation as employed in the discharge of ink. Alternatively, the discharge of the washing solution may be performed in such a way that prior to the discharging of the washing solution, external vibration may be applied by ultrasonic wave to the washing solution charged in the printer head to promote the solubility of solid matters in the printer head.

Next, the details of each of the components of the washing solutions according to the embodiments of the present invention will be explained.

The washing solutions according to the embodiments of the present invention contain, as a major component, at lease 50 parts by weight of a polymerizable compound having a lowest viscosity among plural kinds of polymerizable compounds to be employed in the photosensitive inkjet ink. The washing solutions according to the embodiments of the present invention may be constituted by using only of this specific kind of polymerizable compound. However, the washing solutions according to the embodiments of the present invention may be formulated by incorporating therein a predetermined quantity of other kinds of polymerizable compounds.

As for the polymerizable compounds to be employed as a major component, it is possible to employ mono- or polyvalent acrylate-based or methacrylate-based monomers, epoxy-based monomers, oxetane, or monomers or oligomers having a polymerizable group such as vinyl-based and propenyl-based groups. Since the polymerizable compounds are generally designed such that the viscosity of the ink becomes not more than 50 mPa·s at ordinary temperature, the solvent will be also selected from those having a viscosity of not more than 50 mPa·s at ordinary temperature.

Examples of the acrylate-based monomer include, for example, 2-acryloyloxyethyl hexahydrophthalate, 2-ethyl, 2-butyl-propanediol acrylate, 2-ethylhexyl acrylate, 2-ethylhexyl carbitol acrylate, 2-hydroxybutyl acrylate, 2-hydroxyethyl acrylate, 2-hydroxypropyl acrylate, 2-methoxyethyl acrylate, 3-methoxybutyl acrylate, 4-hydroxybutyl acrylate, benzyl arylate, butoxyethyl acrylate, caprolactone acrylate, cyclohexyl acrylate, dicyclopentanyl acrylate, dicyclopentenyl acrylate, dicyclopentenyloxyethyl acrylate, diethylene glycol monoethyl ether acrylate, dipropylene glycol acrylate, isoamyl acrylate, isobornyl acrylate, isobutyl acrylate, isodecyl acrylate, isooctyl acrylate, lauryl acrylate, methoxydipropylene glycol acrylate, methoxytripropylene glycol acrylate, methoxytriethylene glycol acrylate, methyl acrylate, phenoxydiethylene glycol acrylate, phenoxyethyl acrylate, phenoxyhexaethylene glycol acryalte, phenoxytetraethylene glycol acrylate, stearyl acrylate, t-butyl acrylate, tetrahydrofurfuryl acrylate, tridecyl acrylate, urethane monoacrylate, 1,3-butylene glycol diacrylate, 1,4-butane diol diacrylate, 1,6-hexane diol diacrylate, 1,9-nonane diol diacrylate, diethylene glycol diacrylate, hydroxy pivalic neopentyl glycol diacrylate, neopentyl glycol diacrylate, polyethylene glycol diacrylate, polypropylene glycol diacrylate, polytetramethylene glycol diacrylate, triethylene glycol diacrylate, tripropylene glycol diacrylate, and dipropylene glycol diacrylate.

Examples of the methacrylate-based monomer include, for example, 1,3-butylene glycol dimethacrylate, 2-ethylhexyl methacrylate, 2-hydroxyethyl methacrylate, 2-hydroxypropyl methacrylate, allyl methacrylate, benzyl methacrylate, cyclohexyl methacrylate, dicyclopentanyl methacrylate, dicyclopentenyloxyethyl methacrylate, diethylaminoethyl methacrylate, glycidyl methacrylate, isodecyl methacrylate, lauryl methacrylate, methoxydiethylene glycol methacrylate, methoxytetraethylene glycol methacrylate, methoxypolyethylene glycol methacrylate, stearyl methacrylate, tetrahydrofurfuryl methacrylate, dodecyl methacrylate, 1,4-butane diol dimethacrylate, diethylene glycol dimethacrylate, ethylene glycol dimethacrylate, glycerol acrylate methacrylate, glycerol dimethacrylate, neopentyl glycol dimethacrylate, polyethylene glycol dimethacrylate, polypropylene glycol dimethacrylate, triethylene glycol dimethacrylate, and tetraethylene glycol dimethacrylate.

Examples of the vinyl-based monomer include, for example, 2-ethylhexyl vinyl ether, butane diol-1,4-divinyl ether, cyclohexane dimethanol divinyl ether, cyclohexane dimethanol monovinyl ether, diethylene glycol divinyl ether, dipropylene glycol divinyl ether, ethyl divinyl ether, hexane diol divinyl ether, hydroxybutyl divinyl ether, 1,4-cyclohexane diol divinyl ether, bisphenol A divinyl ether, menthol vinyl ether, 1-hydroxy-3,5-dimethylbenzene vinyl ether, 2-hydronaphthalene vinyl ether, 1-tert butyl-4-vinyloxycyclohexanol vinyl ether, 1-tert butyl-4-vinyloxybenzene vinyl ether, trimethylcyclohexanol vinyl ether, vinyloxycyclodecanol vinyl ether, 4-hydroxycumylphenol vinyl ether, isoborneol vinyl ether, cumene alcohol vinyl ether, vinyloxybenzene vinyl ether, P-divinyloxybenzene divinyl ether, and isosorbite divinyl ether.

Examples of the propenyl-based monomer include, for example, propylene carbonate propenyl ether and dioxolane methanol isopropenyl.

Examples of the epoxy-based monomer include, for example, Celloxide 3000 (DAICEL UCB), Celloxide 2000 (DAICEL UCB), Adecaoptmer KRM2750 (Asahi Denka Co., Ltd.), Adecaoptmer KRM2722 (Asahi Denka Co., Ltd.), Adecaoptmer KRM2720 (Asahi Denka Co., Ltd.), neopentyl glycol glycidyl ether, 1,6-hexane diol diglycidyl ether, tripropylene glycol diglycidyl ether, diethylene glycol diglycidyl ether, butyl glycidyl ether, and phenyl glycidyl ether.

Examples of the oxetane compound include, for example, 3-ethyl-3-hydroxymethyl oxetane, 3-ethyl-3-(phenoxymethyl) oxetane, di[1-ethyl(3-oxetanyl)] methyl ether, 3-ethyl-3-(2-ethylhexyloxymethyl) oxetane, and 3-ethyl-3-{[3-(triethoxysilyl)propoxy]methyl} oxetane.

In addition to the solvents exemplified above, it is also possible, while taking the viscosity of the ink being employed into consideration, to employ the following solvents.

For example, it is possible to employ polyacrylate compounds of polyhydric alcohol compounds, polyacrylate compounds of polyhydric aromatic alcohols, polyacrylate compounds of polyhydric alicyclic alcohols, and styrene compounds having a substituent group. Examples of such monomers include, for example, di- or polyacrylate compounds of ethylene glycol, polyethylene glycol, propylene glycol, glycerin, neopentyl alcohol, trimethylol propane, pentaerythritol, such as vinyl alcohol-based oligomers; urethane acrylate compounds; di- or polyacrylate compounds of phenol, cresol, naphthol, bisphenol, novolac-based condensation compounds of these aromatic alcoholic compouns, and vinyl phenolic oligomers; and mono- or polyacrylate compounds of cyclohexane, hydrogenated bisphenol, decahydronaphthalene alicyclic compounds, terpene-based alicyclic compounds, and mono- or polyhydroxyl compounds of dicyclopentane or tricyclodecane-based alicyclic compounds. It is also possible to suitably employ compounds where a group containing vinyl ether is substituted for an acrylate moiety of the aforementioned compounds.

Further, it is also possible to employ compounds having both of cationic polymerizable properties and radical polymerizable properties, such as methacrylate having an alicyclic epoxy group (for example, CEL2000 (DAICEL Chemicals Co., Ltd.), or Cyclomer (trade name, DAICEL Chemicals Co., Ltd.)), methacrylate having methylglycidyl group (MGMA), glycidyl methacrylate, and ester compounds made from vinyl alcohol and acrylic or methacrylic compound.

The features which printed matters are required to have differ depending on the intended use thereof. Namely, it may be sometimes required to employ a photosensitive ink having a sufficiently high-curing property for coping with a high-velocity printing. For example, there is situations where a high-velocity printing of as high as several tens meters per minute is required to be performed or where printed matters are required to be resistive to solvents. It is found possible to meet these requirements by using acrylate compounds having an oxetane skeleton. In this case, it is effective, for washing out this photosensitive ink, to employ a washing solution comprising the same kind of polymerizable compound as employed in the ink.

Examples of such monomers include, for example, 1-acryloyloxy,4-(1-ethyl-3 oxetanyl)methoxy benzene, 1-acryloyloxy,3-(1-ethyl-3 oxetanyl)methoxy benzene, 4-acryloyloxy, 4'-(3-ethyl-3 oxetanyl)methoxy biphenyl, compounds having oxetane or acrylic group which is bonded to a side chain of phenol novolac, oxetanyl(acryl)silsesquioxane, ester compounds formed of 3-ethyl-3-hydroxymethyl oxetane and acrylic acid, 1-acryloyloxy,4-(1-ethyl-3 oxetanyl)methoxy cyclohexane, 1-acryloyloxy,4-(3-ethyl-3 oxetanyl)methoxy cyclohexane, 1-acryloyloxy,2-(1-ethyl-3 oxetanyl)methoxy norbornane, and aliphatic or alicyclic compounds having acrylic group and oxetane group.

The compounds having an epoxy skeleton which is bonded to an acrylic side chain are also effective as in the case of the oxetane compounds. Examples of such compounds include glycidyl acrylate, glycidyl methacrylate, Cyclomer (trade name, DAICEL Chemicals Co., Ltd.), and compounds having at least one acrylic group which is attached to epoxy compounds such as limonene oxide.

Some kinds of photosensitive inkjet ink, which are safe and easy in handling, substantially free from odor and VOC and capable of giving high-quality printed matters, contain therein, as a polymerizable solvent, an acrylic compound or a vinyl compound each having a side chain which is constituted by a terpenoid skeleton. As for the polymerizable solvents to be employed in the washing solutions for washing out such kinds of photosensitive inkjet ink, it is possible to employ the following acrylic compounds or vinyl ether compounds.

As for the acrylic compounds having a terpenoid skeleton attached to the ester side chain thereof, acrylic compounds disclosed in JP Patent Laid-open Publication (Kokai) 08-82925 (1996) can be suitably employed as monomers.

As for acrylic compounds, it is possible to employ ester compounds which can be obtained by epoxidizing the double bond of terpen and adding acrylic acid or methacrylic acid. As for terpen which can be used include, for example, terpen having unsaturated linkage such as myrcene, careen, ocimene, pinene, limonene, camphene, terpinolene, tricyclene, terpinene, fenchene, phellandrene, sylvestrene, sabinene, dipentene, bornene, isopregol, carvone, etc. Alternatively, it is also possible to employ ester compounds to be derived from acrylic acid or methacrylic acid and alcohols originated from terpene such as citronellol, pinocampheol, geraniol, phentyl alcohol, nerol, borneol, linalol, menthol, terpineol, thujyl alcohol, citroneral, ionone, irone, cinerol, citral, pinol, cyclocitral, carvomenthone, ascaridole, safranal, piperithol, menthenemonol, dihydrocarvone, carveol, sclareol, manool, hinokiol, ferruginol, totarol, sugiol, farnesol, patchouli alcohol, nerolidol, carotol, cadinol, lantheol, eudesmol, phytol, etc. It is also possible to employ acrylic compounds or methacrylic compounds having, on their side chains, a skeleton such as citronellic acid, hinokiic acid, santalic acid, menthone, carvotanacetone, phellandral, pimelitenone, peryl aldehyde, thujone, carone, tagetone, camphor, bisabolene, santalene, zingiberene, caryophyllene, curcumene, cedrene, cadinene, longifolene, sesquibenihene, cedrol, guaiol, kessoglycol, cyperone, eremophilone, zerumbone, campholene, podocarprene, mirene, phyllocladene, totalene, ketomanoyl oxide, manoyl oxide, abietic acid, pimaric acid, neoabietic acid, levopimaric acid, iso-d-pimaric acid, agathene dicarboxylic acid, rubenic acid, carotenoid, pelary aldehyde, piperitone, ascaridole, pimene, fenchene, sesquiterpenes, diterpenes, triterpenes, etc.

As for the vinyl ether having a terpenoid skeleton on the ether side chain thereof, they include compounds where vinyl ether compounds having a vinyl ether group or a substituent group are substituted for the hydrogen atom of alcohols originated from terpene such as citronellol, pinocampheol, geraniol, phentyl alcohol, netol, borneol, linalol, menthol, terpineol, thujyl alcohol, citroneral, ionone, irone, cinerol, citral, pinol, cyclocitral, carvomenthone, ascaridole, safranal, piperithol, menthenemonol, dihydrocarvone, carveol, sclareol, manool, hinokiol, ferruginol, totarol, sugiol, farnesol, patchouli alcohol, nerolidol, carotol, cadinol, lantheol, eudesmol, phytol, etc.

It is also possible to employ ester compounds to be derived from the combination of vinyl alcohol and an acid having a terpenoid skeleton such as citronellic acid, hinokiic acid, santalic acid, abietic acid, pimaric acid, neoabietic acid, etc.

In addition to the aforementioned compounds, terpene-based compounds having, on their substituent groups, an olefin structure can be also employed.

The acrylic compounds having an ester side chain which is constituted by a terpenoid skeleton or the vinyl ether compounds having an ether side chain which is constituted by a terpenoid skeleton should preferably include a structure represented by the following general formulas (2) or (3).

(2)

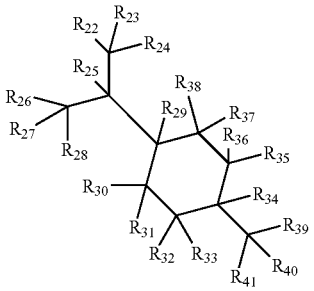

(3)

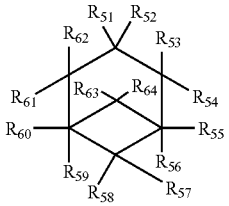

In the general formula (2), $R_{22}$ to $R_{41}$ may be the same or different wherein at least one of $R_{22}$ to $R_{41}$ is acryloyloxy group, methacryloyloxy group or substituted or unsubstituted vinyl ether, the rest being individually hydrogen atom, alkyl group, hydroxyl group or alkyl ester. However, a couple of Rs selected from $R_{22}$ to $R_{41}$ and bonded to a specific carbon atom of the ring may be substituted by ketone and a couple of Rs selected from $R_{22}$ to $R_{41}$ and bonded respectively to a couple of neighboring carbon atoms may be substituted by a cyclic ether such as epoxy or oxetane.

In the general formula (3), $R_{51}$ to $R_{64}$ may be the same or different wherein at least one of $R_{51}$ to $R_{64}$ is acryloyloxy group, methacryloyloxy group or substituted or unsubstituted vinyl ether, the rest being individually hydrogen atom, alkyl group, hydroxyl group or alkyl ester. However, a couple of Rs selected from $R_{51}$ to $R_{64}$ and bonded to a specific carbon atom of the ring may be substituted by ketone and a couple of Rs selected from $R_{51}$ to $R_{64}$ and bonded respectively to a couple of neighboring carbon atoms may be substituted by a cyclic ether such as epoxy or oxetane.

Especially, when the terpenoid skeleton is a menthane skeleton, the resultant polymerizable compounds would be greatly improved in stability and the odor thereof can be sufficiently minimized and hence would be preferable for use. Since the vinyl ether compounds are far superior in environmental safety and lower in irritation to skin as compared with acrylic compounds, the employment of the skeleton of vinyl ether compounds is much desirable.

By formulating the washing solution so as to contain a polymerizable compound having a lowest viscosity among the polymerizable compounds to be included in the composition of ink at a ratio of 50 parts by weight or more, it is now possible to realize desirable effects even if a polymerizable compound of higher viscosity is included in the ink. Therefore, the mixing ratio of this polymerizable compound having a lowest viscosity should preferably be 50 parts by weight or more, more preferably 70 parts by weight or more. If the mixing ratio is confined to 20 parts by weight at most, even if non-polymerizable compounds such as DMSO (dimethyl sulfoxide) or MEK (methylethyl ketone) is included in the washing solutions of the embodiments of the present invention, the performance of the washing solutions would not be deteriorated.

As for the polymerization inhibitor to be incorporated into the washing solutions according to the embodiments of the present invention, it is possible to employ any compound which is capable of supplementing radicals. For example, it is possible to employ hydroquinone, phenol derivatives such as 4-methoxyhydroxy benzene, and oxygen/sulfur-containing compounds such as phenothiazine. It is also possible to employ other compounds such as methoquinone, DOHQ (Wako Co., Ltd.) and DHHQ (Wako Co., Ltd.).

As for the cationic polymerization inhibitor, it is possible to employ any kind of base which is consisted of a basic compound or a compound which is capable of expressing basicity and can be dissolved in an acid-polymerizable solvent, and hence the cationic polymerization inhibitor may be an inorganic base or an organic base. In view of solubility in the solvent, the organic base is more preferable. Specific examples of such an organic base include ammonia or ammonium compounds, substituted or unsubstituted alkyl amines, substituted or unsubstituted aromatic amines, and organic amines having a heterocyclic skeleton such as pyridine, pyrimidine and imidazole. More specifically, it is possible to employ n-hexyl amine, dodecyl amine, aniline, dimethyl aniline, diphenyl amine, triphenyl amine, diazabicyclooctane, diazabicycloundecane, 3-phenyl pyridine, 4-phenyl pyridine, lutidine, 2,6-di-t-butylpyridine, and sulfonyl hydrazides such as 4-methylbenzene sulfonyl hydrazide, 4,4'-oxybis(benzenesulfonyl hydrazide) and 1,3-benzenesulfonyl hydrazide. Ammonium compounds can be also employed as a basic compound. These basic compounds can be employed singly or in combination of two or more.

Further, pyridine derivatives, aniline derivatives, aminonaphthalene derivatives, other kinds of nitrogen-containing heterocyclic compounds and the derivatives thereof can be also suitably employed.

Specific examples of the pyridine derivatives include 2-fluoropyridine, 3-fluoropyridine, 2-chloropyridine, 3-chloropyridine, 3-phenylpyridine, 2-benzylpyridine, 2-formylpyridine, 2-(2'-pyridyl) pyridine, 3-acetylpyridine, 2-bromopyridine, 3-bromopyridine, 2-iodopyridine, 3-iodopyridine, and 2,6-di-tert-butylpyridine.

Specific examples of the aniline derivatives include aniline, 4-(p-aminobenzoyl) aniline, 4-benzylaniline, 4-chloro-N,N-dimethylaniline, 3-5-dibromoaniline, 2,4-dichloroaniline, N,N-dimethylaniline, N,N-dimethyl-3-nitroaniline, N-ethylaniline, 2-fluoroaniline, 3-fluoroaniline, 4-fluoroaniline, 2-iodoaniline, N-methylaniline, 4-methylthioaniline, 2-bromoaniline, 3-bromoaniline, 4-bromoaniline, 4-bromo-N,N-dimethylaniline, 2-chloroaniline, 3-chloroaniline, 4-chloroaniline, 3-chloro-N,N-dimethylaninilline, 3-nitroaniline, 4-nitroaniline, 2-methoxyaniline, 3-methoxyaniline, diphenylamine, 2-biphenylamine, o-toluidine, m-toluidine, p-toluidine, 3,3'-diaminodiphenyl sulfone, 4,4'-diaminodiphenyl sulfone, and 4,4'-bis(4-aminophenoxy) diphenyl sulfone.

Specific examples of the aminonaphthalene derivatives include, for example, 1-amino-6-hydroxynaphthalene, 1-naphthylamine, 2-naphthylamine, diethylaminonaphthalene, and N-methyl-1-naphthylamine.

Specific examples of other kinds of nitrogen-containing heterocyclic compounds and the derivatives thereof include, for example, cinnoline, 3-acetylpiperidine, pyrazine, 2-methylpyraxzine, methylaminopyrazine, pyridazine, 2-aminopyrimidine, 2-amino-4,6-dimethylpyrimidine, 2-amino-5-nitropyrimidine, 2,4,6-triamino-1,3,5-triazine, pyrrol, pyrazole, 1-methylpyrazole, 1,2,4-triazole, indazole, benzotriazole, quinazoline, quinoline, 3-aminoquinoline, 3-bromoquinoline, 8-carboxyquinoline, 3-hydroxyquinoline, 6-methoxyquinoline, 5-methylquinoline, quinoxaline, thiazole, 2-aminothiazole, 3,4-diazaindole, purine, 8-azapurine, indole and indolizine.

The polymerization inhibitor is incorporated in the washing solution at a ratio of about 0.1 to 1.0 part by weight based on the polymerizable compounds in the washing solution for attaining the effects thereof.

If required, surfactants or pigment dispersants may be added to the washing solutions according to the embodiments of the present invention. Namely, it is possible to incorporate a small quantity of dispersants such as nonionic or ionic surfactants and charge control agents. Further, it is also possible to employ polymer type dispersing agents such as acryl and vinyl alcohol having characteristics similar to the aforementioned dispersants. These additives are employed at a mixing ratio that would not deteriorate the performance of the washing solution.

Next, the present invention will be explained in detail with reference to specific examples.

Herein, one example of the ink prepared according to the following formulation will be taken up so as to explain the washing solution which is suited for this ink. However, the present invention should not be construed to be limited by this example. The polymerizable compounds to be employed as a main component may be changed depending on the composition of the ink to obtain the washing solutions according to the embodiments of the present invention.

| | |
|---|---|
| Yellow pigment (PY-180) | 5 parts by weight |
| Dispersant (Avicia; Solsperse 32000) | 3 parts by weight |
| Dispersant (Avicia; Solsperse 22000) | 0.3 parts by weight |
| Polymerizable solvent (DAICEL Chemicals; Celloxide 3000) | 55 parts by weight |
| Polymerizable solvent (Sakamoto Yakuhin; SR-NPG) | 36.7 parts by weight |

These materials were mixed together and the resultant mixture was subjected to a dispersing treatment for 2 hours by a circulatory sand mill into which beads having a diameter of 0.5 mm were charged. Then, the resultant mixture was subjected to filtration using 5 μm membrane filter to remove coarse particles, thus forming Ink Sample 1. The same procedures as described above were repeated except that PGE (phenylglycidyl ether; Sakamoto Yakuhin Industries) was substituted for C3000, thereby preparing Ink Sample 2.

By using these ink samples, printing was performed and then, the washing solution was evaluated according to the following process. The composition of the washing solution is illustrated in detail in each of the examples to be discussed later. Incidentally, in Example 8, Ink Sample 2 was employed and in other examples, Ink Sample 1 was employed.

(1) First of all, by using an inkjet printer, the printing was performed using these ink samples to confirm that there were no nozzles which were indicating discharge failure.

(2) The printer head which was filled with the ink in the aforementioned step (1) was stored for one week at a temperature of 60° C.

(3) When the printing was performed again by using the printer head that had been stored. As a result, some of the nozzles were found indicating discharge failure. The number of such defective nozzles was counted and referred to as $E_0$.

(4) The ink was discharged from the printer head and a washing solution was introduced into the printer and discharged from the printer to wash the printer head.

(5) The printer head was filled again with the ink to perform the printing to count the number of such defective nozzles indicating discharge failure, the number of which being referred to as $E_1$.

(6) The recovery factor=$(E_0-E_1)/E_0$ x 100(%) was calculated. Based on the recovery factor thus obtained, the washing solutions were evaluated as follows. If the recovery factor was 90% or more, there is practically no problem.

A: 100%

B: 90% to less than 100%

C: 80% to less than 90%

D: less than 80%

Incidentally, in the Examples 7, 8 and 9, after the step (4), the printer heads were filled respectively with a washing solution and then stored for one week at a temperature of 60° C. Thereafter, the printer heads were subjected to the step (6) to evaluate the washing solutions.

EXAMPLE 1

C3000 and SR-NPG were mixed together according to the recipe (weight parts) shown in the following Table 1 to prepare five washing solutions. Each of the washing solutions was evaluated according to the aforementioned procedures. The results thus obtained are summarized in the following Table 1. Incidentally, the viscosity of C3000 was 7.1 mPa·s at ordinary temperature, and the viscosity of SR—NPG was 18.1 mPa·s at ordinary temperature.

TABLE 1

| Washing solution | | C3000 | SR-NPG | Recovery factor |
|---|---|---|---|---|
| Ex. | 1-1 | 70 | 30 | B |
| | 1-2 | 60 | 40 | B |
| | 1-3 | 50 | 50 | B |
| Comp. Ex. | 1-1 | 40 | 60 | C |
| | 1-2 | 30 | 70 | D |

All of the washing solutions containing not less than 50 parts by weight of C3000 having the lowest viscosity among the polymerizable compounds included in the ink indicated a recovery factor of 90% or more.

EXAMPLE 2

C3000, SR-NPG and SR-GLG (glycerin polyglycidyl ether: Sakamoto Yakuhin Industries) were mixed together according to the recipe (weight parts) shown in the following Table 2 to prepare five washing solutions. Each of the washing solutions was calculated according to the aforementioned formula (1) to determine the viscosity at ordinary temperature thereof and evaluated according to the aforementioned procedures. The results thus obtained are summarized together with the viscosity in the following Table 2.

TABLE 2

| Washing solution | | C3000 | SR-NPG | SR-GLG | Viscosity (mPa · s) | Recovery factor |
|---|---|---|---|---|---|---|
| Ex. | 2-1 | 50 | 20 | 30 | 22 | A |
| | 2-2 | 50 | 10 | 40 | 28 | A |
| | 2-3 | 50 | 5 | 45 | 31 | B |
| Comp. | 2-1 | 40 | 10 | 50 | 38 | C |
| Ex. | 2-2 | 45 | 5 | 55 | 47 | D |

It will be recognized from the results shown in Table 2 that the washing solutions having a viscosity of not more than 30 mPa·s indicated excellent detergency, i.e. a recovery factor of as high as 100%.

EXAMPLE 3

C3000, PEPC (propylene carbonate propenyl ether: ISP Co., Ltd.) and DDVE (dodecyl vinyl ether: ISP Co., Ltd.) were mixed together according to the recipe (weight parts) shown in the following Table 3 to prepare seven washing solutions. Based on the formula described in Polymer Handbook, the solubility parameter (S2) of each of the washing solutions was determined, and then, a difference between the solubility parameter (S2) and the solubility parameter (S1) of the ink was determined. This difference is summarized together with the results evaluated of the washing solutions in the following Table 3.

TABLE 3

| Washing solution | | C3000 | PEPC | DDVE | Difference in SP value | Recovery factor |
|---|---|---|---|---|---|---|
| Ex. | 3-1 | 70 | 30 | — | 1.38 | A |
| | 3-2 | 100 | — | — | 0.58 | A |
| | 3-3 | 70 | — | 30 | −0.34 | A |
| | 3-4 | 30 | — | 70 | −1.57 | C |
| Comp. | 3-1 | — | 100 | — | 3.26 | D |
| Ex. | 3-2 | — | — | 100 | −2.49 | D |
| | 3-3 | 30 | 70 | — | 2.46 | C |

Table 3 clearly shows that the difference of solubility parameter is +2 or more, it is possible to achieve a recovery factor of 100%, thus enabling to obtain excellent detergency.

EXAMPLE 4

By using a 1 μm capsule filter, the washing solution of aforementioned Example 1-1 was subjected to recycling filtration, wherein the filtration time was varied to prepare five washing solutions. The number of particles existing in the washing solution was counted by using the Accusizer. The number of particles thus counted is summarized together with the results evaluated of the washing solutions in the following Table 4.

TABLE 4

| Washing solution | Number of particles in washing solution (per 10 cc) | Recovery factor |
|---|---|---|
| 4a | 3000 | A |
| 4b | 4000 | A |

TABLE 4-continued

| Washing solution | Number of particles in washing solution (per 10 cc) | Recovery factor |
|---|---|---|
| 4c | 5000 | A |
| 4d | 6000 | B |
| 4e | 7000 | B |

As shown in Table 4, as long as the number of particles existing in the washing solution is limited to 5000 or less, it is possible to further enhance the detergency of the washing solution, thus achieving a recovery factor of 100%.

EXAMPLE 5

C3000 and Sol 32000 were mixed together according to the recipe (weight parts) shown in the following Table 5 to prepare five washing solutions. Sol 32000 was identical with Solperse 32000 which was added as a dispersant to the ink. By using each of the washing solutions, 20000-fold dilute solutions of ink were prepared and the number of particles included in each of these dilute solutions was counted by using the Accusizer. The number of particles thus counted is summarized together with the results evaluated of the washing solutions in the following Table 5.

TABLE 5

| Washing solution | C3000 | Sol32000 | Number of particles (per 10 cc) | Recovery factor |
|---|---|---|---|---|
| 5a | 99 | 1 | 40000 | A |
| 5b | 99.5 | 0.5 | 45000 | A |
| 5c | 99.95 | 0.05 | 50000 | A |
| 5d | 99.99 | 0.01 | 55000 | B |
| 5e | 100 | 0 | 60000 | B |

Table 5 shows that, as long as the number of particles existing in the washing solution is limited to 5000 or less, it is possible to further enhance the detergency of the washing solution.

EXAMPLE 6

C3000 and Sol 32000 were mixed together according to the recipe (weight parts) shown in the following Table 6 to prepare five washing solutions. By using each of the washing solutions, 10000-fold dilute solutions of ink were prepared to obtain samples for measuring ζ-potential. The ζ-potentials of the ink and of the dilute solutions of ink were measured by using ELS8000 (Ohtsuka Denshi Co., Ltd.) to determine a difference thereof. The difference thus counted is summarized together with the results evaluated of the washing solutions in the following Table 6.

TABLE 6

| Washing solution | C3000 | Sol32000 | Difference in ζ potential | Recovery factor |
|---|---|---|---|---|
| 6a | 99 | 1 | 5 | A |
| 6b | 99.5 | 0.5 | 7 | A |
| 6c | 99.95 | 0.05 | 10 | A |
| 6d | 99.99 | 0.01 | 13 | B |
| 6e | 100 | 0 | 17 | B |

As shown in Table 6, as long as the difference of ζ-potential is confined to 10 mV or less, it is possible to further enhance the detergency of the washing solution.

EXAMPLE 7

As a polymerization inhibitor, N,N-dimethyl aniline was added to the washing solutions according to the recipe (weight parts) shown in the following Table 7 to prepare four washing solutions. The results evaluated of the washing solutions are summarized in the following Table 7.

TABLE 7

| Washing solution | C3000 | N,N-dimethyl aniline | Recovery factor |
|---|---|---|---|
| 7-1 | 99.9 | 0.1 | A |
| 7-2 | 99.8 | 0.2 | A |
| 7-3 | 99.5 | 0.5 | A |
| 7-4 | 1000 | 0 | B |

Table 7 shows that, by the addition of the polymerization inhibitor, it was possible to suppress the thermal deterioration and changes with time of the washing solutions, thus making it possible to further enhance the detergency of the washing solution.

EXAMPLE 8

SR-2EG (diethylene glycol diglycidyl ether: Sakamonto Yakuhin Industries), SR—NPG and PGE (phenyl glycidyl ether: Sakamonto Yakuhin Industries) were mixed together according to the recipe (weight parts) shown in the following Table 8 to prepare three washing solutions. Incidentally, the number of the functional groups in SR-2EG was 2 and the number of the functional group in PGE was 1. The results evaluated of the washing solutions are summarized in the following Table 8.

TABLE 8

| Washing solution | SR-2EG | SR-NPG | PGE | Recovery factor |
|---|---|---|---|---|
| 8a | 50 | 0 | 50 | A |
| 8b | 0 | 50 | 50 | A |
| 8c | 50 | 50 | 0 | B |

It will be recognized from Table 8 that, by the inclusion of PGE where the number of the functional group is 1, it is possible to further enhance the detergency of washing solution.

EXAMPLE 9

As inert compounds, diethylene glycol diethyl ether (SR-2EG inert) and neopentyl glycol diethyl ether (SR-NPG inert) were prepared. By using these compounds, four washing solutions were prepared according to the recipe (weight parts) shown in the following Table 9.

TABLE 9

| Washing solution | 50% | 50% | Recovery factor |
|---|---|---|---|
| 9a | C3000 | SR-2EG inert | A |

TABLE 9-continued

| Washing solution | 50% | 50% | Recovery factor |
|---|---|---|---|
| 9b | C3000 | SR-NPG inert | A |
| 9c | C3000 | SR-2EG | B |
| 9d | C3000 | SR-NPG | B |

The diethylene glycol diethyl ether was a compound represented by the aforementioned general formula (1) wherein R was a bivalent group represented by the following formula; inert organic group $A^1$ and organic group $A^2$ were both ethyl group; n=2; and m=1.

$$—O—(CH_2)_2—O—(CH_2)_2—O—$$

Further, the neopentyl glycol diethyl ether was a compound represented by the aforementioned general formula (1) wherein R was a bivalent group represented by the following formula; inert organic group $A^1$ and organic group $A^2$ were both ethyl group; n=2; and m=1.

$$—O—CH_2—C(CH_3)_2—CH_2—O—$$

It will be recognized that the washing solutions containing an inert compound was capable of further enhancing the detergency of washing solution without generating impurities formed of polymerized gel-like matters even during the storage thereof.

EXAMPLE 10

By using C3000, DMSO and MEK, various washing solutions were prepared according to the recipe shown in the following Table 10. The results evaluated of the washing solutions are summarized in the following Table 10.

TABLE 10

| Washing solution | | C3000 | DMS0 | MEK | Recovery factor |
|---|---|---|---|---|---|
| Ex. | 10-1 | 70 | 30 | — | B |
| | 10-2 | 50 | 50 | — | B |
| | 10-3 | 70 | — | 30 | B |
| | 10-4 | 50 | — | 50 | B |
| Comp. | 10-1 | 30 | 70 | — | C |
| Ex. | 10-2 | 30 | — | 70 | C |
| | 10-3 | — | 30 | 70 | D |
| | 10-4 | — | 50 | 50 | D |
| | 10-5 | — | 70 | 30 | D |

DMSO and MEK are both a non-polymerizable solvent. When the content of these solvents was higher than 50 parts by weight, the detergency of the washing solutions was caused to deteriorate. Further, when the content of these solvents was 100 parts by weight, the detergency of the washing solutions was further deteriorated. It was recognized that, in the case of the washing solution to be employed for washing out a photosensitive ink, the existence of a polymerizable solvent having detergency was essential.

EXAMPLE 11

By using the washing solution of Example 1-1, the washing of nozzles was performed while forcedly applying an additional pressure to the washing solution at the moment when the washing solution was discharged from the nozzles. As a result, it was confirmed possible to reduce the washing time.

As described above, according to one aspect of the present invention, there is provided a washing solution which is capable of effectively washing the inkjet printer head where a photosensitive ink is employed. According to another aspect of the present invention, there is provided a washing method which makes it possible to effectively wash the inkjet printer head where a photosensitive ink is employed.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A washing method for washing an inkjet printer head which performs printing by feeding an ink containing at least two kinds of polymerizable compounds each differing in viscosity, a photopolymerization initiator, and pigment, comprising:

filling the interior of the inkjet printer head with a washing solution containing not less than 50 parts by eight of a polymerizable compound selected from the at least two kinds of polymerizable compounds included in the ink and having a lowest viscosity among the at least two kinds of polymerizable compounds, or not less than 50 parts by weight of a polymerizable compound having a viscosity of 30 mPa·sec or less at ordinary temperature; and discharging the washing solution from a nozzle of the inkjet printer head.

2. The washing method according to claim 1, wherein the polymerizable compound is selected from the group consisting of mono- or polyvalent acrylate-based or methacrylate-based monomers, epoxy-based monomers, oxetane, or monomers or oligomers having a polymerizable group selected from the group consisting of vinyl-based and propenyl-based groups.

3. The washing method according to claim 1, wherein the polymerizable compound is an epoxy-based monomer.

4. The washing method according to claim 1, wherein the polymerizable compound having a lowest viscosity or the polymerizable compound having a viscosity of 30 mPa·sec or less is employed at a ratio of 70 parts by weight or more.

5. The washing method according to claim 1, wherein the solubility parameter S2($MPa^{1/2}$) of the washing solution is confined within the range to be represented by the following formula 1 as the solubility parameter S1($MPa^{1/2}$) of the ink to be washed is taken into account:

$$S1-2 \leqq S2 \leqq S1+2 \qquad \text{formula 1.}$$

6. The washing method according to claim 1, wherein the number of the particles having a diameter of not less than 0.5 μm in the washing solution is confined to not more than 5000 per 10 cc.

7. The washing method according to claim 1, wherein, when the ink to be washed is diluted 20000-fold with the washing solution, the number of particles having a diameter of 0.5 μm or more in the diluted solution is confined to 50000 or less per 10 cc.

8. The washing method according to claim 1, wherein, when the zeta potential of the ink to be washed is defined as Z1(mV) and the zeta potential of a 10-fold to tens of thousands-fold dilute ink solution which is diluted with the washing solution is defined as Z2(mV), a difference between Z1 and Z2 is not more than ±10 mV.

9. The washing method according to claim 8, wherein Z1(mV) and Z2(mV) is of the same sign with each other.

10. The washing method according to claim 1, wherein the washing solution further comprises a polymerization inhibitor.

11. The washing method according to claim 10, wherein the polymerization inhibitor is selected from the group consisting of hydroquinone, phenol derivatives, oxygen-containing compounds and sulfur-containing compounds.

12. The washing method according to claim 10, wherein the polymerization inhibitor is incorporated in the washing solution at a ratio of 0.1 to 1.0 part by weight based on the polymerizable compounds.

13. The washing method according to claim 1, wherein the ink contains a compound having one polymerizable functional group, and the washing solution also contains this compound.

14. The washing method according to claim 1, wherein the washing solution further comprises at least one selected from the group consisting of a surfactant, a pigment dispersant, a charge control agent and a polymer-dispersing agent.

15. The washing method according to claim 1, wherein the polymerizable compound to be included in the ink has one kind of polymerizable functional group selected from the group consisting of vinyl group, acryloyl group, (metha)acryloyl group, glycidyl group, oxetane and oxirane; and the washing solution contains a polymerizable compound represented by the following formula 2:

$$(A^1)m-R-(A^2)n-m \qquad \text{formula 2}$$

wherein R is an aliphatic skeleton, an alicyclic skeleton or a skeleton containing oxygen atom; $A^1$ is an organic group which is inert to a photopolymerization initiator to be included in the ink; $A^2$ is a group selected from the group consisting of an organic group which is inert to a photopolymerization initiator to be included in the ink, vinyl group, acryloyl group, (metha)acryloyl group, glycidyl group, oxetane and oxirane; n is a natural number of 2 or more; and m is a natural number ranging from 1 to not more than n.

16. The washing method according to claim 15, wherein R in the general formula 1 is selected from the following skeletons:

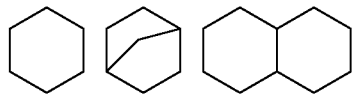

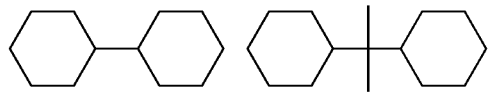

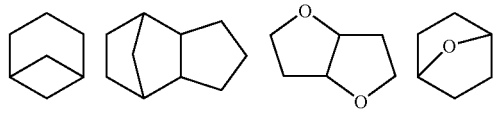

-continued

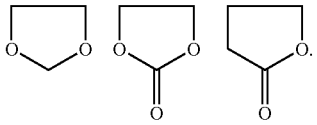

17. The washing method according to claim 15, wherein $A^1$ and $A^2$ in the general formula 1 are individually selected from the group consisting of methyl, ethyl, methoxy, ethoxy, isopropyl and t-butyl groups.

18. The washing method according to claim 1, wherein the at least one kind of polymerizable compounds has one kind of polymerizable functional group selected from the group consisting of vinyl group, glycidyl group, oxetane and oxirane.

* * * * *

UNITED STATES PATENT AND TRADEMARK OFFICE

CERTIFICATE OF CORRECTION

PATENT NO. : 7,425,525 B2
APPLICATION NO. : 11/063474
DATED : September 16, 2008
INVENTOR(S) : Ryozo Akiyama et al.

It is certified that error appears in the above-identified patent and that said Letters Patent is hereby corrected as shown below:

Col. 19, claim 1, line 7: "50 parts by eight" should be -- 50 parts by weight --.

Signed and Sealed this

Thirtieth Day of December, 2008

JON W. DUDAS
*Director of the United States Patent and Trademark Office*